US006051105A

United States Patent [19]

Ampulski

[11] Patent Number: 6,051,105

[45] **Date of Patent: *Apr. 18, 2000**

[54] METHOD OF WET PRESSING TISSUE PAPER WITH THREE FELT LAYERS

[75] Inventor: Robert Stanley Ampulski, Fairfield, Ohio

[73] Assignee: The Procter & Gamble Company, Cincinnati, Ohio

[ * ] Notice: This patent is subject to a terminal disclaimer.

[21] Appl. No.: 09/127,859

[22] Filed: Aug. 3, 1998

Related U.S. Application Data

[63] Continuation of application No. 08/858,069, May 16, 1997, Pat. No. 5,830,316.

[51] Int. Cl.[7] ..... D21H 11/00

[52] U.S. Cl. ..... 162/117; 162/358.2; 162/358.1

[58] Field of Search ..... 162/117, 358.2, 162/358.1, 109, 358.3

[56] References Cited

U.S. PATENT DOCUMENTS

| | | | |
|---|---|---|---|
| 3,014,832 | 12/1961 | Donnelly | 162/111 |
| 3,214,329 | 10/1965 | Wicker | 162/900 |
| 3,214,330 | 10/1965 | Wicker | 162/358.2 |
| 3,214,331 | 10/1965 | Wicker | 162/358.2 |
| 3,230,136 | 1/1966 | Krake | 162/111 |
| 3,301,746 | 1/1967 | Sanford et al. | 162/113 |
| 3,303,576 | 2/1967 | Sisson | 34/115 |
| 3,537,954 | 11/1970 | Justus | 162/305 |
| 3,556,940 | 1/1971 | Cronin | 162/358.2 |
| 3,629,056 | 12/1971 | Forrest | 162/305 |
| 3,824,152 | 7/1974 | Nevalainen | 162/301 |
| 3,840,429 | 10/1974 | Busker | 162/205 |
| 3,905,863 | 9/1975 | Ayers | 162/113 |
| 3,974,026 | 8/1976 | Emson et al. | 162/358 |
| 3,981,084 | 9/1976 | Sobota | 34/123 |
| 4,139,410 | 2/1979 | Tapio et al. | 162/206 |
| 4,144,124 | 3/1979 | Turunen et al. | 162/290 |
| 4,191,609 | 3/1980 | Trokhan | 162/113 |
| 4,196,045 | 4/1980 | Ogden | 162/117 |
| 4,201,624 | 5/1980 | Mohr et al. | 162/205 |
| 4,229,253 | 10/1980 | Cronin | 162/358 |
| 4,239,065 | 12/1980 | Trokhan | 139/383 |
| 4,287,021 | 9/1981 | Justus et al. | 162/358 |
| 4,309,246 | 1/1982 | Hulit et al. | 162/113 |
| 4,309,574 | 1/1982 | Wood | 428/36 |
| 4,356,059 | 10/1982 | Hostetler | 162/111 |
| 4,420,372 | 12/1983 | Hostetler | 162/280 |
| 4,421,600 | 12/1983 | Hostetler | 162/111 |
| 4,514,345 | 4/1985 | Johnson et al. | 264/136 |
| 4,529,480 | 7/1985 | Trokhan | 162/109 |
| 4,559,258 | 12/1985 | Kuichi | 428/156 |
| 4,561,939 | 12/1985 | Justus | 162/360.1 |
| 4,781,967 | 11/1988 | Legge | 162/900 |

(List continued on next page.)

FOREIGN PATENT DOCUMENTS

| | | | |
|---|---|---|---|
| 2109781 | 5/1994 | Canada | D21F 3/08 |
| 0 400 843 A2 | 5/1990 | European Pat. Off. | D21F 3/04 |
| 2071293 | 9/1981 | United Kingdom | F26B 13/24 |
| WO 95/17548 | 6/1995 | WIPO | D21F 11/00 |
| WO 96/00812 | 1/1996 | WIPO | D21F 11/00 |
| WO 96/00813 | 1/1996 | WIPO | D21F 11/00 |
| WO 96/00814 | 1/1996 | WIPO | D21F 11/00 |

OTHER PUBLICATIONS

Rolf Maisch, Johann Moser and Voith Sulzer PaperAge Jan. 1996 pp. 24–27, "Highspeed Shoepress NipcoFlex Fractional Experiences From Perlen".

*Primary Examiner*—Brenda A. Lamb
*Attorney, Agent, or Firm*—Jay A. Krebs; Larry L. Huston; Donald E. Hasse

[57] ABSTRACT

The present invention provides method for making a wet pressed paper web. An embryonic web of papermaking fibers is formed on a foraminous forming member, and transferred to an imprinting member to deflect a portion of the papermaking fibers in the embryonic web into deflection conduits in the imprinting member. The web and the imprinting member are then pressed in a compression nip with first, second, and third dewatering felt layers.

16 Claims, 5 Drawing Sheets

U.S. PATENT DOCUMENTS

| | | | |
|---|---|---|---|
| 5,062,924 | 11/1991 | McCarten | 162/358 |
| 5,098,522 | 3/1992 | Smurkoski et al. | 162/358 |
| 5,178,732 | 1/1993 | Steiner et al. | 162/360.2 |
| 5,245,025 | 9/1993 | Trokhan et al. | 536/56 |
| 5,274,930 | 1/1994 | Ensign et al. | 34/23 |
| 5,308,450 | 5/1994 | Braun et al. | 162/360 |
| 5,389,205 | 2/1995 | Pajula et al. | 162/205 |
| 5,393,384 | 2/1995 | Steiner | 162/358.2 |
| 5,514,523 | 5/1996 | Trokhan et al. | 430/320 |
| 5,580,423 | 12/1996 | Ampulski et al. | 162/111.7 |
| 5,628,876 | 5/1997 | Ayers et al. | 162/358.2 |
| 5,629,052 | 5/1997 | Trokhan et al. | 427/508 |
| 5,693,187 | 12/1997 | Ampulski et al. | 162/358.2 |

METHOD OF WET PRESSING TISSUE PAPER WITH THREE FELT LAYERS

This application is a continuation of U.S. application Ser. No. 08/858,069 filed May 16, 1997, now U.S. Pat. No. 5,830,316.

FIELD OF THE INVENTION

The present invention is related to papermaking, and more particularly, to a method for making a wet pressed tissue paper web by wet pressing the paper web, an imprinting member, and dewatering felt layers in a press nip.

BACKGROUND OF THE INVENTION

Disposable products such as facial tissue, sanitary tissue, paper towels, and the like are typically made from one or more webs of paper. If the products are to perform their intended tasks, the paper webs from which they are formed must exhibit certain physical characteristics. Among the more important of these characteristics are strength, softness, and absorbency. Strength is the ability of a paper web to retain its physical integrity during use. Softness is the pleasing tactile sensation the user perceives as the user crumples the paper in his or her hand and contacts various portions of his or her anatomy with the paper web. Softness generally increases as the paper web stiffness decreases. Absorbency is the characteristic of the paper web which allows it to take up and retain fluids. Typically, the softness and/or absorbency of a paper web is increased at the expense of the strength of the paper web. Accordingly, papermaking methods have been developed in an attempt to provide soft and absorbent paper webs having desirable strength characteristics.

U.S. Pat. No. 3,301,746 issued to Sanford et al. discloses a paper web which is thermally pre-dried with a through air-drying system. Portions of the web are then impacted with a fabric knuckle pattern at the dryer drum. While the process of Sanford et al. is directed to providing improved softness and absorbency without sacrificing tensile strength, water removal using the through-air dryers of Sanford et al. is very energy intensive, and therefore expensive.

U.S. Pat. No. 3,537,954 issued to Justus discloses a web formed between an upper fabric and a lower forming wire. A pattern is imparted to the web at a nip where the web is sandwiched between the fabric and a relatively soft and resilient papermaking felt, U.S. Pat. No. 4,309,246 issued to Hulit et al. discloses delivering an uncompacted wet web to an open mesh imprinting fabric formed of woven elements, and pressing the web between a papermaker's felt and the imprinting fabric in a first press nip. The web is then carried by the imprinting fabric from the first press nip to a second press nip at a drying drum. U.S. Pat. No. 4,144,124 issued to Turunen et al. discloses a paper machine having a twin-wire former having a pair of endless fabrics, which can be felts. One of the endless fabrics carries a paper web to a press section. The press section can include the endless fabric which carries the paper web to the press section, an additional endless fabric which can be a felt, and a wire for patterning the web.

PCT Publication WO95/17548 having a US priority date of Dec. 20, 1993 and published Jun. 29, 1995 in the name of Ampulski et al.; and PCT Publication WO 96/00813 having a US priority date of Jun. 29, 1994 and published Jan. 11, 1996 in the name of Trokhan et al. disclose papermaking methods employing dewatering felt layers.

Embossing can be used to pattern a web. However, embossing the web after the web is dried can disrupt fiber bonds, and ultimately decrease the strength of the web. While suitable methods of making paper webs are disclosed in the art, paper scientists continue to search for even better methods for making patterned paper structures economically and with increased strength, without sacrificing softness and absorbency.

Accordingly, one object of the present invention is to provide a method for dewatering and molding a paper web.

Another object of the present invention is to provide a method of enhancing water removal from a web during pressing of the web.

Another object of the present invention is to press a web and an imprinting member between three felt layers in order to pattern the web and enhance water removal from the web.

Another object of the present invention is to provide a non-embossed patterned paper web having a relatively high density continuous network, and a plurality of relatively low density domes dispersed throughout the continuous network.

SUMMARY OF THE INVENTION

The present invention provides a method for molding and dewatering a paper web. The method comprises forming an embryonic web of papermaking fibers on a forming member, the web having a first face and a second face. The web is then transferred from the foraminous forming member to an imprinting member having a web imprinting surface. The web is deflected on the imprinting member to form a non-monoplanar web of papermaking fibers.

The imprinting member carries the non-monoplanar web to a compression nip. The web and imprinting member are positioned intermediate a first dewatering felt layer and a second dewatering felt layer in the compression nip, wherein the first felt layer is positioned adjacent a first face of the web, and wherein the web imprinting surface of the imprinting member is positioned adjacent the second face of the web. A third dewatering felt layer is positioned adjacent the second dewatering felt layer in the compression nip, wherein the second dewatering felt layer is disposed between the imprinting member and the third dewatering felt layer. The web is pressed in the compression nip to further deflect the fibers of the web to form a molded web.

Without being limited by theory, it is believed that the second dewatering felt acts as an acquisition member to receive water pressed from the web and passing through the imprinting member, while the third dewatering felt layer acts as a storage reservoir to store at least some of the water received by and passing through the second felt. Accordingly, the present invention can be used to more efficiently mold and dry a paper web in a press nip.

BRIEF DESCRIPTION OF THE DRAWINGS

While the specification concludes with claims particularly pointing out and distinctly claiming the present invention, the invention will be better understood from the following description taken in conjunction with the accompanying drawings in which:

DETAILED DESCRIPTION OF THE INVENTION

Figure 1:
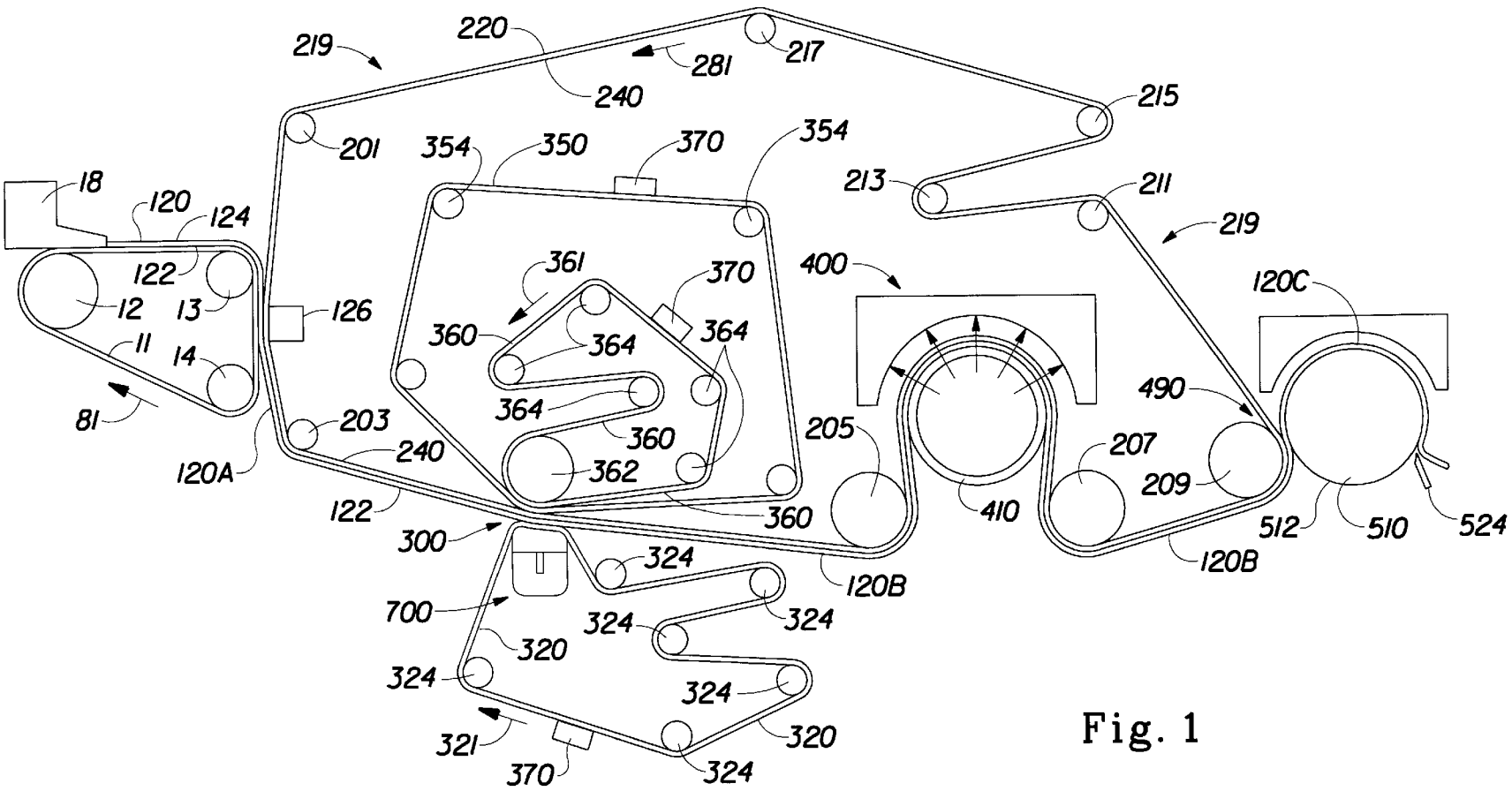
FIG. 1 is a schematic illustration of one embodiment of a continuous papermaking machine illustrating transferring a paper web from a foraminous forming member to a foraminous imprinting member, carrying the paper web on the foraminous imprinting member to a compression nip, and pressing the web carried on the foraminous imprinting member and the three felt layers in the compression nip.

FIG. 1 illustrates one embodiment of a continuous papermaking machine which can be used in practicing the present invention. The process of the present invention comprises a number of steps or operations which occur in sequence. While the process of the present invention is preferably carried out in a continuous fashion, it will be understood that the present invention can comprise a batch operation, such as a handsheet making process. A preferred sequence of steps will be described, with the understanding that the scope of the present invention is determined with reference to the appended claims.

According to one embodiment of the present invention, an embryonic web 120 of papermaking fibers is formed from an aqueous dispersion of papermaking fibers on a foraminous forming member 11. The embryonic web 120 is then transferred, preferably by vacuum transfer, to a foraminous imprinting member 219 having a first web contacting face 220 comprising a web imprinting surface and a deflection conduit portion. A portion of the papermaking fibers in the embryonic web 120 are deflected into the deflection conduit portion of the foraminous imprinting member 219 without densifying the web, thereby forming a non-monoplanar intermediate web 120A.

The intermediate web 120A is carried on the foraminous imprinting member 219 from the foraminous forming member 11 to a compression nip 300. The nip 300 can have a machine direction length of at least about 3.0 inches, and can comprise opposed convex and concave compression surfaces, with the convex compression surface being provided by a press roll 362 and the opposed concave compression surface being provided by a shoe press assembly 700. Alternatively, the nip 300 can be formed between two press rolls.

The web 120A is carried into the nip 300 supported on the imprinting member 219. In the compression nip 300, a first dewatering felt layer 320 is positioned adjacent the intermediate web 120A, a second dewatering felt layer 350 is positioned adjacent the imprinting member 219, and a third dewatering felt 360 is positioned adjacent the second dewatering felt 350, such that one face of the second felt layer 350 is positioned adjacent the imprinting member 219 and the other face of the second felt layer 350 is positioned adjacent the third felt layer 360 in the nip 300.

The intermediate web 120A and the foraminous imprinting member 219 are then pressed between the first felt layer 320 and the second and third dewatering felt layers 350 and 360 in the compression nip 300 to further deflect a portion of the papermaking fibers into the deflection conduit portion of the imprinting member 219; to densify a portion of the intermediate web 120A associated with the web imprinting surface; and to further dewater the web by removing water from both sides of the web, thereby forming a molded web 120B which is relatively dryer than the intermediate web 120A.

At the exit of the compression nip 300, the first felt layer 320 can be separated from the molded web 120B, the second felt layer 350 can be separated from the imprinting member 219, and the third felt layer 360 can be separated from the second felt layer 350. Accordingly, after pressing in the nip 300, the water held in the first felt layer 320 is isolated from the web 120B, the water held in the second felt layer 350 is isolated from the imprinting member 219, and the water held in the third felt layer 360 is isolated from the second felt 350. This isolation helps to prevent water in the third felt layer from re-entering the second felt layer, and water in the second felt from re-entering the member 219 at the exit of the nip, which water could possibly then re-enter the web.

The molded web 120B is preferably carried from the compression nip 300 on the foraminous imprinting member 219. The molded web 120B can be pre-dried in a through air dryer 400 by directing heated air to pass first through the molded web, and then through the foraminous imprinting member 219, thereby further drying the molded web 120B. Alternatively, the dryer 400 can be omitted.

The web imprinting surface of the foraminous imprinting member 219 can then be impressed into the molded web 120B such as at a nip formed between a roll 209 and a dryer drum 510. thereby forming an imprinted web 120C. Impressing the web imprinting surface into the molded web can further densify the portions of the web associated with the web imprinting surface. The imprinted web 120C can then be dried on the dryer drum 510 and creped from the dryer drum by a doctor blade 524.

Examining the process steps according to the present invention in more detail, a first step in practicing the present invention is providing an aqueous dispersion of papermaking fibers derived from wood pulp to form the embryonic web 120. The papermaking fibers utilized for the present invention will normally include fibers derived from wood pulp. Other cellulosic fibrous pulp fibers, such as cotton linters, bagasse, etc., can be utilized and are intended to be within the scope of this invention, Synthetic fibers, such as rayon, polyethylene and polypropylene fibers, may also be utilized in combination with natural cellulosic fibers. One exemplary polyethylene fiber which may be utilized is Pulpex™, available from Hercules, Inc. (Wilmington, Del.). Applicable wood pulps include chemical pulps, such as Kraft, sulfite, and sulfate pulps, as well as mechanical pulps including, for example, groundwood, thermomechanical pulp and chemically modified thermomechanical pulp. Pulps derived from both deciduous trees (hereinafter, also referred to as "hardwood") and coniferous trees (hereinafter, also referred to as "softwood") may be utilized. Also applicable to the present invention are fibers derived from recycled paper which may contain any or all of the above categories as well as other non-fibrous materials such as fillers and adhesives used to facilitate the original papermaking.

In addition to papermaking fibers, other components or materials may be added to the papermaking furnish. The types of additives desirable will be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. No. 3,700,623, issued on Oct. 24, 1972, and U.S. Pat. No. 3,772,076, issued on Nov. 13, 1973, both issued to Keim and both being hereby incorporated by reference. One commercial source of a useful polyamide-epichlorohydrin resins is Hercules. Inc. of Wilmington, Del., which markets such resin under the mark Kymene™ 557H.

Polyacrylamide resins have also been found to be of utility as wet strength resins. These resins are described in U.S. Pat. No. 3,556,932. issued on Jan. 19, 1971, to Coscia, et al. and U.S. Pat. No. 3,556,933, issued on Jan. 19, 1971, to Williams et al., both patents being incorporated herein by reference. One commercial source of polyacrylamide resins is American Cyanamid Co. of Stanford, Conn., which markets one such resin under the mark Parez™ 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention. In addition, temporary wet strength resins such as Caldas 10 (manufactured by Japan Carlit) and CoBond 1000 (manufactured by National Starch and Chemical Company) may be used in the present invention. It is to be understood that the addition of chemical compounds such as the wet strength and temporary wet strength resins discussed above to the pulp furnish is optional and is not necessary for the practice of the present development.

The embryonic web 120 is preferably prepared from an aqueous dispersion of the papermaking fibers, though dispersions of the fibers in liquids other than water can be used. The fibers are dispersed in water to form an aqueous dispersion having a consistency of from about 0.1 to about 0.3 percent. The percent consistency of a dispersion, slurry, web, or other system is defined as 100 times the quotient obtained when the weight of dry fiber in the system under discussion is divided by the total weight of the system. Fiber weight is always expressed on the basis of bone dry fibers.

A second step in the practice of the present invention is forming the embryonic web 120 of papermaking fibers. Referring to FIG. 1, an aqueous dispersion of papermaking fibers is provided to a headbox 18 which can be of any convenient design. From the headbox 18 the aqueous dispersion of papermaking fibers is delivered to a foraminous forming member 11 to form an embryonic web 120. The forming member 11 can comprise a continuous Fourdrinier wire. Alternatively, the foraminous forming member 11 can comprise a plurality of polymeric protuberances joined to a continuous reinforcing structure to provide an embryonic web 120 having two or more distinct basis weight regions, such as is disclosed in U.S. Pat. No. 5,245,025 issued Sep. 14, 1993 to Trokhan et al. which patent is incorporated herein by reference. While a single forming member 11 is shown in FIG. 1, single or double wire forming apparatus may be used. Other forming wire configurations, such as S or C wrap configurations can be used.

The forming member 11 is supported by a breast roll 12 and plurality of return rolls, of which only two return rolls 13 and 14 are shown in FIG. 1. The forming member 11 is driven in the direction indicated by the arrow 81 by a drive means not shown. The embryonic web 120 is formed from the aqueous dispersion of papermaking fibers by depositing the dispersion onto the foraminous forming member 11 and removing a portion of the aqueous dispersing medium. The embryonic web 120 has a first web face 122 contacting the foraminous member 11 and a second oppositely facing web face 124.

The embryonic web 120 can be formed in a continuous papermaking process, as shown in FIG. 1, or alternatively, a batch process, such as a handsheet making process can be used. After the aqueous dispersion of papermaking fibers is deposited onto the foraminous forming member 11, the embryonic web 120 is formed by removal of a portion of the aqueous dispersing medium by techniques well known to those skilled in the art. Vacuum boxes, forming boards, hydrofoils, and the like are useful in effecting water removal from the aqueous dispersion on the foraminous forming member 11. The embryonic web 120 travels with the forming member 11 about the return roll 13 and is brought into the proximity of a foraminous imprinting member 219.

Figure 2:
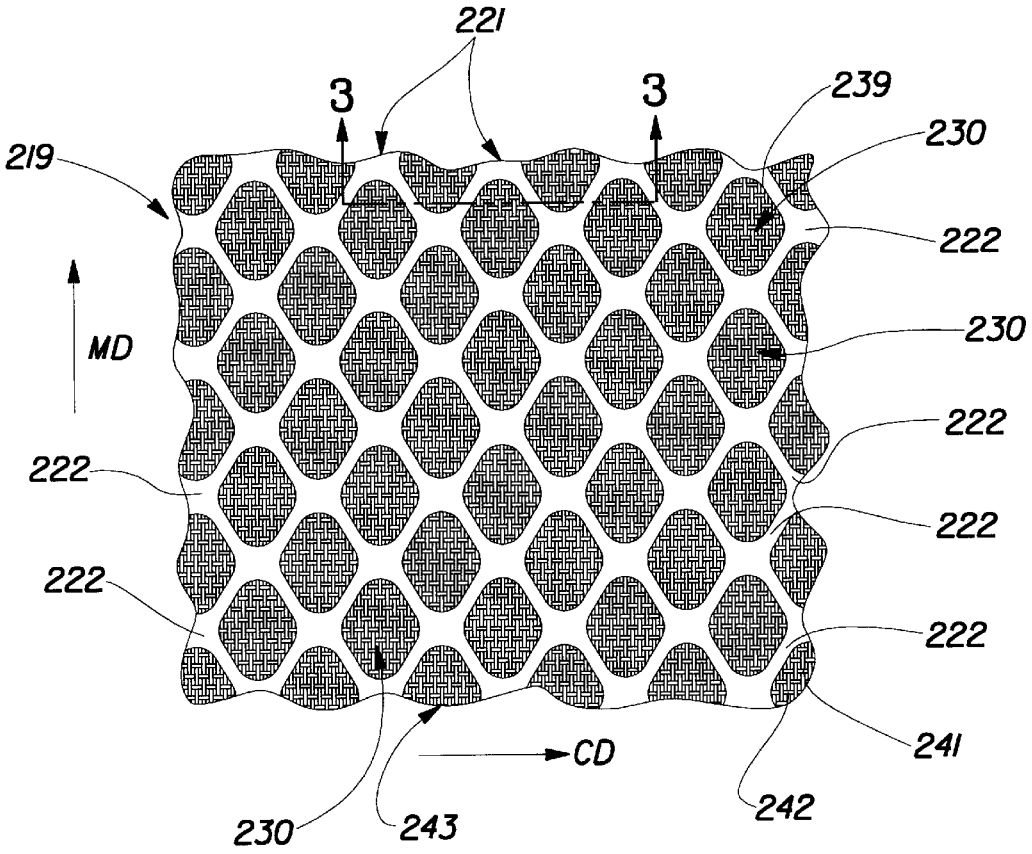
FIG. 2 is a schematic illustration of a plan view of a foraminous imprinting member having a first web contacting face comprising a macroscopically monoplanar, patterned continuous network web imprinting surface defining within the foraminous imprinting member a plurality of discrete, isolated, non connecting deflection conduits.
Figure 3:
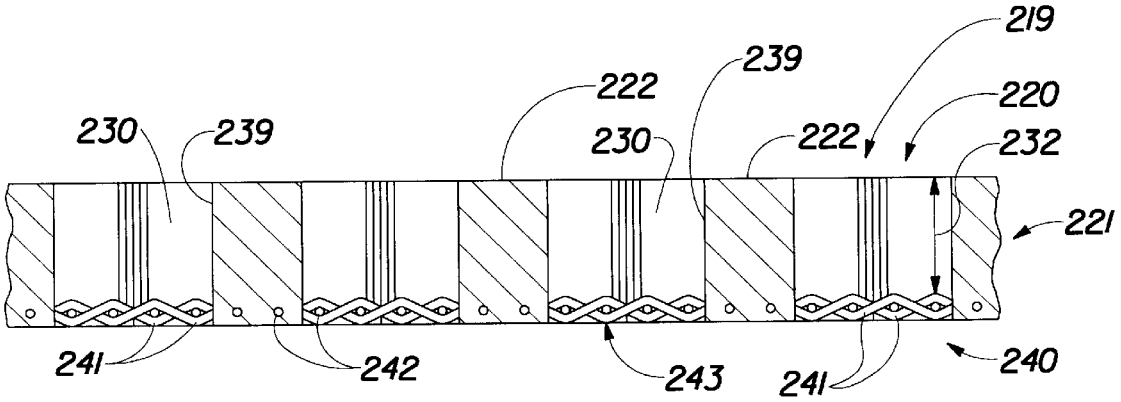
FIG. 3 is a cross-sectional view of a portion of the foraminous imprinting member shown in FIG. 2 as taken along line 3—3.
Figure 4:
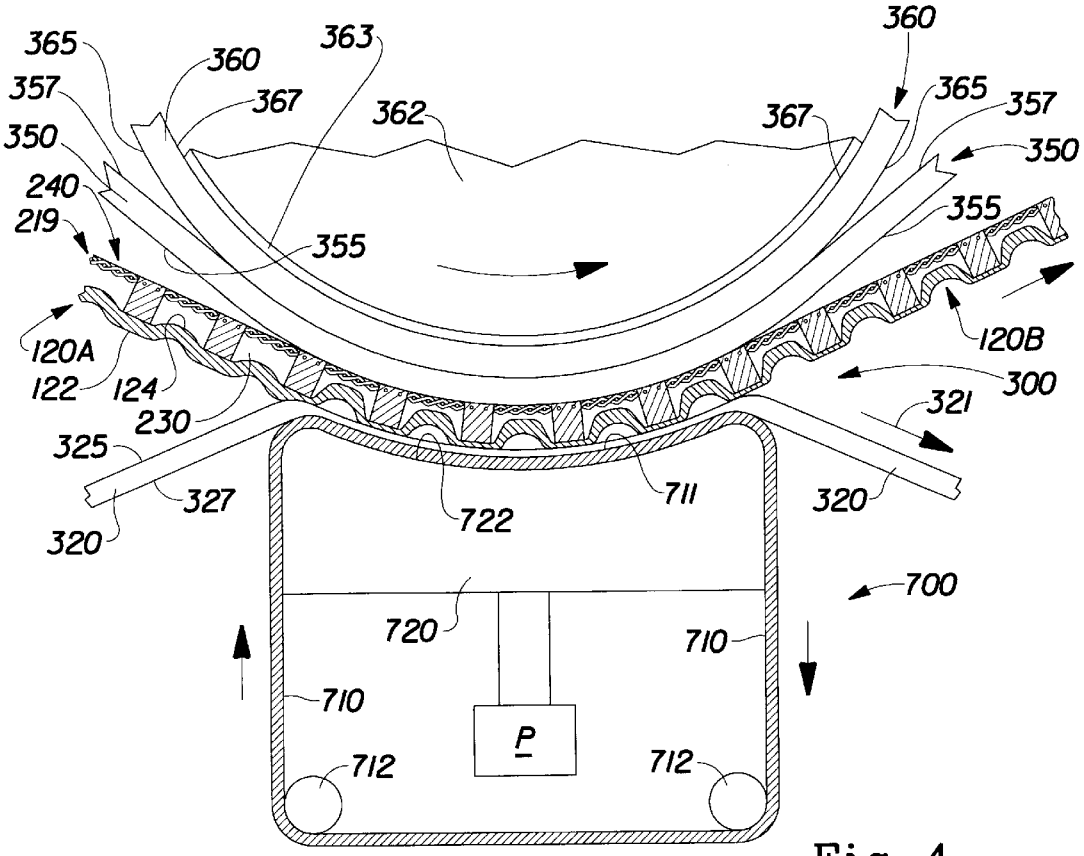
FIG. 4 is an enlarged schematic illustration of the compression nip shown in FIG. 1, showing a first dewatering felt positioned adjacent a first face of the web, the web contacting face of the foraminous imprinting member positioned adjacent the second face of the web, the second dewatering felt positioned adjacent the second felt contacting face of the foraminous imprinting member, and the third felt layer positioned adjacent the second felt layer.

Referring to FIGS. 2–4, the foraminous imprinting member 219 has a first web contacting face 220 and a second felt contacting face 240. The web contacting face 220 has a web imprinting surface 222 and a deflection conduit portion 230, as shown in FIGS. 2 and 3. The deflection conduit portion 230 forms at least a portion of a continuous passageway extending from the first face 220 to the second face 240 for carrying water through the foraminous imprinting member 219. Accordingly, when water is removed from the web of papermaking fibers in the direction of the foraminous imprinting member 219, the water can be disposed of without having to again contact the web of papermaking fibers. The foraminous imprinting member 219 can comprise an endless belt, as shown in FIG. 1, and can be supported by a plurality of rolls 201–217.

The foraminous imprinting member 219 is driven in the direction 281 (corresponding to the machine direction) shown in FIG. 1 by a drive means (not shown). The first web contacting face 220 of the foraminous imprinting member 219 can be sprayed with an emulsion comprising about 90 percent by weight water. about 8 percent petroleum oil, about 1 percent cetyl alcohol, and about 1 percent of a surfactant such as Adogen TA-100. Such an emulsion facilitates transfer of the web from the imprinting member 219 to the drying drum 510. Of course, it will be understood that the foraminous imprinting member 219 need not comprise an endless belt if used in making handsheets in a batch process.

In the embodiment shown in FIGS. 2 and 3, the first web contacting face 220 of the foraminous imprinting member 219 comprises a macroscopically monoplanar, patterned, continuous network web imprinting surface 222 of a resin layer 221. The continuous network web imprinting surface 222 defines within the foraminous imprinting member 219 a plurality of discrete, isolated, non-connecting deflection conduits 230. The deflection conduits 230 have openings 239 which can be random in shape and in distribution, but which are preferably of uniform shape and distributed in a repeating, preselected pattern on the first web contacting face 220. Such a continuous network web imprinting surface 222 and discrete deflection conduits 230 are useful for forming a paper structure having a continuous, relatively high density network region and a plurality of relatively low density domes dispersed throughout the continuous, relatively high density network region, as disclosed in U.S. Pat. No. 4,528,239, issued Jul. 9, 1985 to Trokhan, which patent is incorporated herein by reference.

Suitable shapes for the openings 239 include, but are not limited to, circles, ovals, and polygons, in addition to the shaped openings 239 shown in FIG. 2. The openings 239 can be regularly and evenly spaced in aligned ranks and files. Alternatively, the openings 239 can be bilaterally staggered in the machine direction (MD) and cross-machine direction (CD), as shown in FIG. 2, where the machine direction refers to that direction which is parallel to the flow of the web through the equipment, and the cross machine direction is perpendicular to the machine direction. A foraminous imprinting member 219 having resin layer 221 with a continuous network web imprinting surface 222 and discrete isolated deflection conduits 230 can be manufactured according to the teachings of the following U.S. Patents which are incorporated herein by reference: U.S. Pat. No. 4,514,345 issued Apr. 30, 1985 to Johnson et al.; U.S. Pat. No. 4,529,480 issued Jul. 16, 1985 to Trokhan; and U.S. Pat. No. 5,098,522 issued Mar. 24, 1992 to Smurkoski et al.; and U.S. Pat. No. 5,514,523 issued May 7, 1996 to Trokhan et al.

Referring to FIGS. 2 and 3, the foraminous imprinting member 219 can include a woven reinforcement element 243 for strengthening the foraminous imprinting member 219. The reinforcement element 243 can include machine direction reinforcing strands 242 and cross machine direction reinforcing strands 241, though any convenient weave pattern can be used. The openings in the woven reinforcement element 243 formed by the interstices between the strands 241 and 242 are smaller than the size of the openings 239 of the deflection conduits 230. Together, the openings in the woven reinforcement element 243 and the openings 239 of the deflection conduits 230 provide a continuous passageway extending from the first face 220 to the second face 240 for carrying water through the foraminous imprinting member 219. The reinforcement element 243 can also provide a support surface for limiting deflection of the fibers into the deflection conduits 230, and thereby help to prevent the formation of apertures in the portions of the web associated with the deflection conduits 230, such as the relatively low density domes 1084. Such apertures, or pinholing, can be caused by water or air flow through the deflection conduits when a pressure difference exists across the web, The area of the web imprinting surface 222, as a percentage of the total area of the first web contacting surface 220, should be between about 15 percent to about 65 percent, and more preferably between about 20 percent to about 50 percent. The deflection conduits 230 can have a depth 232 (FIG. 3) which is between about 0.1 mm and about 1.0 mm. Alternatively the depth 232 can be essentially zero, and the thickness of the resin layer 221 can be less than or equal to the thickness of the reinforcement element 243.

In an alternative embodiment, the foraminous imprinting member 219 can comprise a fabric belt formed of woven filaments. The web imprinting surface 222 can be formed by discrete knuckles formed at the cross-over points of the woven filaments. Suitable woven filament fabric belts for use as the foraminous imprinting member 219 are disclosed in U.S. Pat. No. 3,301,746 issued Jan. 31, 1967 to Sanford et al., U.S. Pat. No. 3,905,863 issued Sep. 16, 1975 to Ayers, U.S. Pat. No. 4,191,609 issued Mar. 4, 1980 to Trokhan, and U.S. Pat. No. 4,239,065 issued Dec. 16, 1980 to Trokhan, which patents are incorporated herein by reference.

In another alternative embodiment, the foraminous imprinting member 219 can have a first web contacting face 220 comprising a continuous patterned deflection conduit encompassing a plurality of discrete, isolated web imprinting surfaces. Such a foraminous imprinting member 219 can be used to form a molded web having a continuous, relatively low density network region, and a plurality of discrete, relatively high density regions dispersed throughout the continuous, relatively low density network. Such a foraminous imprinting member is shown in U.S. Pat. No. 4,514,345 issued Apr. 30, 1985 to Johnson et al., which patent is incorporated herein by reference. In yet another embodiment, the foraminous imprinting member 219 can have a first web contacting face 220 comprising a plurality of semicontinuous web imprinting surfaces 222. As used herein, a pattern of web imprinting surfaces 222 is considered to be semicontinuous if a plurality of the imprinting surfaces 222 extend substantially unbroken along any one direction on the web contacting face 220, and each imprinting surface is spaced apart from adjacent imprinting surfaces 220 by a deflection conduit 230. The web contacting face 220 can have adjacent semicontinuous imprinting surfaces 222 spaced apart by semicontinuous deflection conduits 230. The semicontinuous imprinting surfaces 222 can extend generally parallel to the machine or cross-machine directions, or alternatively, extend along a direction forming an angle with respect to the machine and cross-machine directions. Such a foraminous imprinting member is shown in U.S. patent application Ser. No. 07/936,954. Papermaking Belt Having Semicontinuous Pattern and Paper Made Thereon, filed Aug. 26, 1992 in the name of Ayers et al., which application is incorporated herein by reference.

A third step in the practice of the present invention comprises transferring the embryonic web 120 from the foraminous forming member 11 to the foraminous imprinting member 219, to position the second web face 124 on the first web contacting face 220 of the foraminous imprinting member 219.

A fourth step in the practice of the present invention comprises deflecting a portion of the papermaking fibers in the embryonic web 120 into the deflection conduit portion 230 of web contacting face 220, and removing water from the embryonic web 120 through the deflection conduit portion 230 to form an intermediate web 120A of the papermaking fibers. The embryonic web 120 preferably has a consistency of between about 5 and about 20 percent at the point of transfer to facilitate deflection of the papermaking fibers into the deflection conduit portion 230.

The steps of transferring the embryonic web 120 to the imprinting member 219 and deflecting a portion of the papermaking fibers in the web 120 into the deflection conduit portion 230 can be provided, at least in part, by applying a differential fluid pressure to the embryonic web 120. For instance, the embryonic web 120 can be vacuum transferred from the forming member 11 to the imprinting member 219, such as by a vacuum box 126 shown in FIG.

1, or alternatively, by a rotary pickup vacuum roll (not shown). The pressure differential across the embryonic web 120 provided by the vacuum source (e.g., the vacuum box 126) deflects the fibers into the deflection conduit portion 230, and preferably removes water from the web through the deflection conduit portion 230 to raise the consistency of the web to between about 18 and about 30 percent. The pressure differential across the embryonic web 120 can be between about 13.5 kPa and about 40.6 kPa (between about 4 to about 12 inches of mercury). The vacuum provided by the vacuum box 126 permits transfer of the embryonic web 120 to the foraminous imprinting member 219 and deflection of the fibers into the deflection conduit portion 230 without compacting the embryonic web 120. Additional vacuum boxes can be included to further dewater the intermediate web 120A.

Referring to FIG. 4, portions of the intermediate web 120A are shown deflected into the deflection conduits 230 upstream of the compression nip 300, so that the intermediate web 120A is non-monoplanar. The intermediate web 120A is shown having a generally uniform thickness (distance between first and second web faces 122 and 124) upstream of the compression nip 300 to indicate that a portion of the intermediate web 120A has been deflected into the imprinting member 219 without locally densifying or compacting the intermediate web 120A upstream of the compression nip 300. Transfer of the embryonic web 120 and deflection of the fibers in the embryonic web into the deflection conduit portion 230 can be accomplished essentially simultaneously. Above referenced U.S. Pat. No. 4,529,480 is incorporated herein by reference for the purpose of teaching a method for transferring an embryonic web to a foraminous member and deflecting a portion of the papermaking fibers in the embryonic web into the foraminous member.

Referring to FIGS. 1 and 4, the web is transferred to be supported on the imprinting member 219 upstream of the nip 300. The imprinting member 219 has a relatively high air permeability, relatively open structure. The imprinting member 219 has an air permeability of at least about 250 scfm. Because of the relatively high air permeability, open structure of the imprinting member 219, the vacuum box 126 can effectively remove water from the web through the imprinting member 219, and little (if any) water is contained in the imprinting member 219 after transfer of the web to the imprinting member 219. As a result, re-wet of the web by water in the imprinting member 219 is believed to be minimized.

In addition, the felts 320 and 350 are separated from the web and the imprinting member 219 upstream of the nip 300. Accordingly, the felts 320 and 350 are not adjacent the web or the member 219 upstream of the nip, and the felts 320 and 350 can be relatively dry when the felts 320 and 360 enter the nip 300 in order to provide efficient drying of the web.

A fifth step in the practice of the present invention comprises pressing the wet intermediate web 120A in the compression nip 300 to form the molded web 120B. Referring to FIGS. 1 and 4, the intermediate web 120A is carried on the foraminous imprinting member 219 from the foraminous forming member 11 and through the compression nip 300 formed between the opposed compression surfaces of roll 362 and shoe press assembly 700. In order to describe the operation of the compression nip 300, the imprinting member 219, dewatering felts 320, 350, and 360, and the paper web are drawn enlarged relative to the roll 362 and the press assembly 700.

The first dewatering felt 320 is shown supported in the compression nip adjacent the press shoe assembly 700, and is driven in the direction 321 around a plurality of felt support rolls 324. The shoe press assembly 700 includes a fluid impervious pressure belt 710, a pressure shoe 720, and pressure source P. The pressure shoe 720 can have a generally arcuate, concave surface 722. The pressure belt 710 travels in a continuous path over the generally concave surface 722 and the guide rolls 712. The pressure source P provides hydraulic fluid under pressure to a cavity (not shown) in the pressure shoe 720. The pressurized fluid in the cavity urges the pressure belt 710 against the felt 320, and provides the loading of the compression nip 300. Shoe press assemblies are disclosed generally in the following U.S. Patents, which are incorporated herein by reference: U.S. Pat. No. 4,559,258 to Kiuchi; U.S. Pat. No. 3,974,026 to Emson et al.; U.S. Pat. No. 4,287,021 to Justus et al.; U.S. Pat. No. 4,201,624 to Mohr et al.; U.S. Pat No. 4,229,253 to Cronin; U.S. Pat. No. 4,561,939 to Justus; U.S. Pat. No. 5,389,205 to Pajula et al.; U.S. Pat. No. 5,178,732 to Steiner et al.; U.S. Pat. No. 5,308,450 to Braun et al. One suitable shoe press assembly is a SYM-BELT S brand shoe press available from Valmet Company of Sweden.

The outer surface of the pressure belt 710 takes on a generally arcuate, concave shape as it passes over the pressure shoe 720, and provides a concave compression surface facing oppositely to the convex compression surface provided by press roll 362. This portion of the outer surface of the pressure belt 710 passing over the pressure shoe is designated 711 in FIG. 4, The outer surface of the pressure belt 710 can be smooth or grooved.

The convex compression surface provided by the press roll 362 in combination with the oppositely facing concave compression surface provided by the shoe press assembly 700 provide an arcuate compression nip having machine direction length which is at least about 3.0 inch. In one embodiment, the compression nip 300 has a machine direction length of between about 3.0 to about 20.0 inches, and more preferably between about 4.0 inches and about 10.0 inches.

The second dewatering felt 350 can be supported to travel around a plurality of felt support rolls 354. and travels through the compression nip 300 positioned between the imprinting member 219 and the third felt 360. The third dewatering felt 360 can be supported to travel around a plurality of felt support rolls 364, and travels through the compression nip 300 positioned between the nip roll 362 and the second felt 350.

Referring to FIGS. 1 and 4, the felt layers 320, 350, and 360 can be supported about their respective support rolls 324, 354, and 364 such that at the exit of nip 300, the first felt 320 is separated from the web 120B, the second felt 350 is separated from the imprinting member 219, and the third felt is separated from the second felt 360.

A felt dewatering apparatus 370, such as a Uhle vacuum box can be associated with each of the dewatering felts 320, 350, and 360 to remove water transferred to the dewatering felts from the intermediate web 120A.

The press roll 362 can have a generally smooth surface, Alternatively, the roll 362 can be grooved, or have a plurality of openings in flow communication with a source of vacuum for facilitating water removal from the intermediate web 120A. The roll 362 can have a rubber coating 363, such as a bonehard rubber cover, which can be smooth, grooved, or perforated. The rubber coating 363 shown in FIG. 4 provides a convex compression surface which faces oppositely to the concave compression surface 711 provided by the shoe press assembly 700.

The term "dewatering felt" as used herein refers to a member which is absorbent, compressible, and flexible so that it is deformable to follow the contour of the non-monoplanar intermediate web 120A on the imprinting member 219, and capable of receiving and containing water pressed from an intermediate web 120A. The dewatering felts 320 and 360 can be formed of natural materials, synthetic materials, or combinations thereof.

Figure 8:
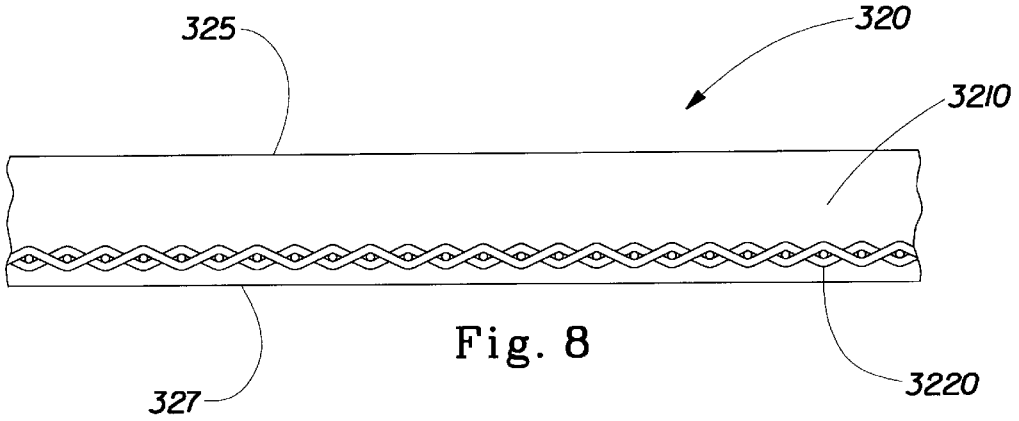
FIG. 8 is a cross-sectional illustration of a dewatering felt.

A suitable dewatering felt layer comprises a nonwoven batt of natural or synthetic fibers joined, such as by needling, to a woven base reinforcing structure formed of woven filaments. FIG. 8 is a cross-sectional illustration of a dewatering felt layer 320 having a nonwoven batt 3210 joined, such as by needling, to a woven base reinforcing structure 3220.

Suitable materials from which the nonwoven batt can be formed include but are not limited to natural fibers such as wool and synthetic fibers such as polyester and nylon. The fibers from which the nonwoven batt is formed can have a denier of between about 3 and about 40 grams per 9000 meters of filament length. The felt can have a layered construction, and comprise a mixture of fiber types and sizes.

The dewatering felt 320 can have a first surface 325 having a relatively high density, relatively small pore size, and a second surface 327 having a relatively low density, relatively large pore size. Likewise, the second dewatering felt 350 can have a first surface 355 having a relatively high density, relatively small pore size. and a second surface 357 having a relatively low density, relatively large pore size. Similarly, the third dewatering felt 360 can have a first surface 365 having a relatively high density, relatively small pore size, and a second surface 367 having a relatively low density, relatively large pore size.

The first dewatering felt 320 can have a thickness of between about 2 mm to about 5 mm, a basis weight of about 800 to about 2000 grams per square meter, an average density (basis weight divided by thickness) of between about 0.35 gram per cubic centimeter and about 0.45 gram per cubic centimeter.

Each of the first, second and third felt layers 320, 350, and 360 can have an air permeability between about 5 and about 200 scfm, and more particularly, between about 5 and about 100 scfm. The air permeability is a measure of the number of cubic feet of air which pass through the thickness of the felt layer. per minute, per square foot of felt area. The air permeability is measured at a pressure differential across the dewatering felt thickness of 0.12 kPa (0.5 inch of water). The air permeability is measured using a Valmet permeability measuring device (Model Wigo Taifin Type 1000 using Orifice #1) available from the Valmet Corp. of Pansio, Finland, or an equivalent device.

In one embodiment, the first dewatering felt 320 has an air permeability of less than 50 scfm, and more particularly between about 15 and about 30 scfm, Additionally, the first felt 320 can have a water holding capacity of at least about 150 milligrams of water per square centimeter of surface area, and a small pore capacity of at least about 100 milligrams per square centimeter. The water holding capacity is a measure of the amount of water held in pores having an effective radius between about 5 and about 500 micrometers in a one square centimeter section of the felt. The small pore capacity is a measure of the amount of water that can be contained in relatively small capillary openings in a one square centimeter section of a dewatering felt. By relatively small openings it is meant capillary openings having an effective radius of between about 5 to about 75 micrometers. Such capillary openings are similar in size to those in a wet paper web.

The water holding capacity and small pore capacity of a felt are measured using liquid porosimeter, such as a TRI Autoporosimeter available from TRI/Princeton Inc. of Princeton, N.J. The water holding capacity and small pore capacity are measured according to a methodology described in U.S. patent application Ser. No 08/461,832 "Web Patterning Apparatus Comprising a Felt Layer and a Photosensitive Resin Layer", filed Jun. 5, 1995 in the name of Trokhan et al., which patent application is incorporated herein by reference.

A suitable first dewatering felt 320 is an AmSeam-2, Style 2732 having a 1:1 batt to base ratio (1 pound batt material for every one pound of woven base reinforcing structure) and a 3 over 6 layered batt construction (3 denier fibers over 6 denier fibers, where the 3 denier fibers are adjacent the surface 325 of the felt layer. Such a felt is available from Appleton Mills of Appleton, Wis. and can have an air permeability of about 25 cubic feet per minute per square foot.

The second dewatering felt 350 can have a thickness of between about 2 mm to about 5 mm, a basis weight of about 800 to about 2000 grams per square meter. and an average density (basis weight divided by thickness) of between about 0.35 gram per cubic centimeter and about 0.45 gram per cubic centimeter.

The second felt 350 can have a water holding capacity which is less than that of the first felt 320. The second felt 350 can also have a small pore capacity which is less than that of the first felt 320. The second felt 350 can have a water holding capacity of less than about 150 milligrams of water per square centimeter of surface area, and a small pore capacity of less than about 100 milligrams per square centimeter.

The second felt 350 can have an air permeability of at least about 30 cubic feet per minute per square foot, and in one embodiment has an air permeability of at least about 40 cubic feet per minute per square foot, In one embodiment. the second felt 350 has an air permeability of between about 40 and about 120 cubic feet per minute per square foot.

A suitable second dewatering felt 350 is an AmFlex-3S Style 5615 having a 1:1 batt to base ratio and a 3 over 40 layered batt construction. Such a felt is available from Appleton Mills of Appleton. Wis. and can have an air permeability of about 40 cubic feet per minute per square foot.

The relatively high density and relatively small pore size of the first felt surfaces 325, 355 promote rapid acquisition of the water pressed from the web in the nip 300. The relatively low density and relatively large pore size of the second felt surfaces 327, 357 provide space within the dewatering felts for storing water pressed from the web in the nip 300.

The surface 365 of the third felt layer 360 an have a relatively high density and relatively small pore size as compared to the surface 367 of the third felt layer 360. In one embodiment, the felt layer 360 can have a construction similar to, or identical to, that of the first felt layer 320. In particular. the third felt layer 360 can have an air permeability less than that of the second felt layer 350. The surface 365 can have a relatively high density and relatively small pore size as compared to the surface 357 of the second felt layer 350. Without being bound by theory, it is believed that the relatively finer capillary structure of the surface 365 will tend to draw water from the relatively coarser capillary structure of the surface 357, so that water adjacent to the surface 357 in the second felt layer 350 will be drawn to the surface 365 and stored in the third felt layer 360.

A suitable third dewatering felt 360 is an AmSeam-2, Style 2732 having a 1:1 batt to base ratio (1 pound batt material for every one pound of woven base reinforcing structure) and a 3 over 6 layered batt construction (3 denier fibers over 6 denier fibers, where the 3 denier fibers are adjacent the surface 365 of the felt layer. Such a felt is available from Appleton Mills of Appleton. Wis. and can have an air permeability of about 25 cubic feet per minute per square foot.

The dewatering felts 320, 350, and 360 can have a compressibility of between 20 and 80 percent, preferably between 30 and 70 percent, and more preferably between 40 and 60 percent. The "compressibility" as used herein is a measure of the percentage change in thickness of the dewatering felt under a given loading, and the measurement of compressibility is provided in PCT Publication WO/95/17548 published Jun. 29, 1995 in the name of Ampulski, which publication is incorporated herein by reference. It is particularly desirable that the second felt layer 350 have a compressibility of at least about 40 to 60 percent so that second felt layer 350 can conform to the openings defined by the woven filaments 241 and 242 in the web imprinting member 219.

Referring to FIGS. 1 and 4, the first surface 325 of the first dewatering felt 320 is positioned adjacent the first face 122 of the intermediate web 120A as the first dewatering felt 320 is carried into the nip 300 and over the belt 710. Similarly, the first surface 355 of the second dewatering felt 350 is positioned adjacent the second felt contacting face 240 of the foraminous imprinting member 219 as the second dewatering felt 350 is carried into the nip 300 and around the nip roll 362. The first surface 365 of the third dewatering felt 360 is positioned adjacent the second surface 357 of the second felt 350, and the second surface 367 of the third dewatering felt 360 is positioned adjacent the nip roll 362 as the third dewatering felt 360 is carried into the nip 300. Accordingly, as the intermediate web 120A is carried through the compression nip 300 on the foraminous imprinting member 219, the intermediate web 120A, the imprinting member 219, and the first, second and third dewatering felts 320, 350, and 360 are pressed together between the opposed compression surfaces of the nip 300.

Pressing the intermediate web 120A in the compression nip 300 further deflects the paper making fibers into the deflection conduit portion 230 of the imprinting member 219, and removes water from the intermediate web 120A to form the molded web 120B. The water removed from the web is received by and contained in the dewatering felts 320, 350 and 360.

More particularly, at least some of the water received by the felt 350 can pass through the felt 350 and be stored in the felt 360. Accordingly, with respect to at least some of the water received by the felt 350 from the web, the felt 350 acts to receive and transport the water to the felt 360, and the felt 360 contains the water until it can be removed by the dewatering apparatus 370.

The intermediate web 120A should have a consistency of between about 14 and about 80 percent at the entrance to the compression nip 300. More preferably, the intermediate web 120A has a consistency between about 15 and about 35 percent at the entrance to the nip 300. The papermaking fibers in an intermediate web 120A having such a preferred consistency have relatively few fiber to fiber bonds, and can be relatively easily rearranged and deflected into the deflection conduit portion 230 by the first dewatering felt 320.

The intermediate web 120A is preferably pressed in the compression nip 300 at a nip pressure of at least 100 pounds per square inch (psi), and more preferably at least 200 psi. In a preferred embodiment, the intermediate web 120A is pressed in the compression nip 300 at a nip pressure greater than about 400 pounds per square inch.

The machine direction nip length can be between about 3.0 inches and about 20.0 inches. For a machine direction nip length between 4.0 inches to 10.0 inches, the press assembly 700 is preferably operated to provide between about 400 pounds of force per lineal inch of cross machine direction nip width and about 10000 pounds of force per lineal inch of cross machine direction nip width. The cross machine direction nip width is measured perpendicular to the plane of FIG. 4.

Pressing the web, felt layers, and imprinting member in a nip having a machine direction length of at least about 3.0 inches can improve dewatering of the web. For a given paper machine speed, the relatively long nip length increases the residence time of the web and the felts in the nip. Accordingly, water can be more effectively removed from the web, even at higher machine speeds.

The nip pressure in psi is calculated by dividing the nip force exerted on the web by the area of the nip 300. The force exerted by the nip 300 is controlled by the pressure source P, and can be calculated using various force or pressure transducers familiar to those skilled in the art. The area of nip 300 is measured using a sheet of carbon paper and a sheet of plain white paper.

The carbon paper is placed on the sheet of plain paper. The carbon paper and the sheet of plain paper are placed in the compression nip 300 with the dewatering felts 320, 350, and 360, and the imprinting member 219. The carbon paper is positioned adjacent the first dewatering felt 320 and the plain paper is positioned adjacent the imprinting member 219. The shoe press assembly 700 is then activated to provide the desired press force, and the area of the nip 300 at that level of force is measured from the imprint that the carbon paper imparts to the sheet of plain white paper. Likewise, the machine direction nip length and the cross machine direction nip width can be determined from the imprint that the carbon paper imparts to the sheet of plain white paper.

Figure 5:
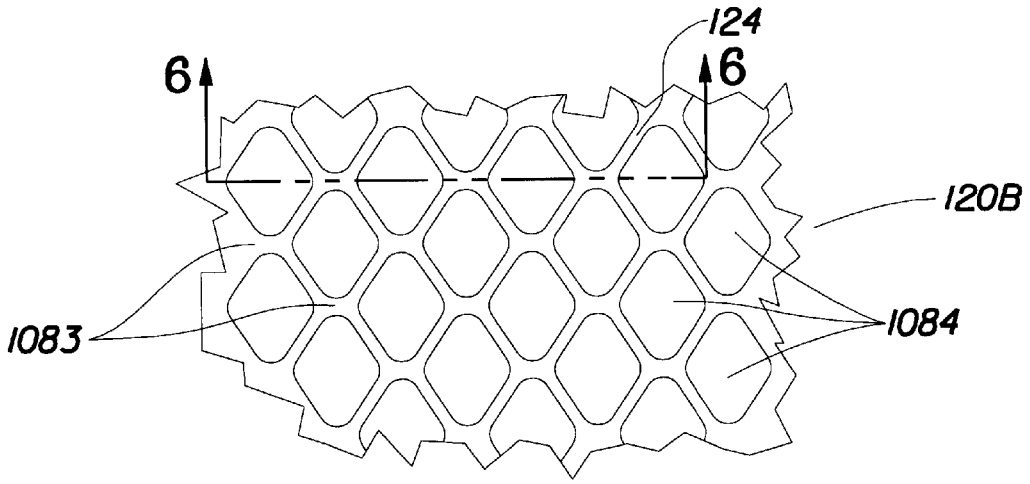
FIG. 5 is plan view of a paper web made according to the present invention.
Figure 6:
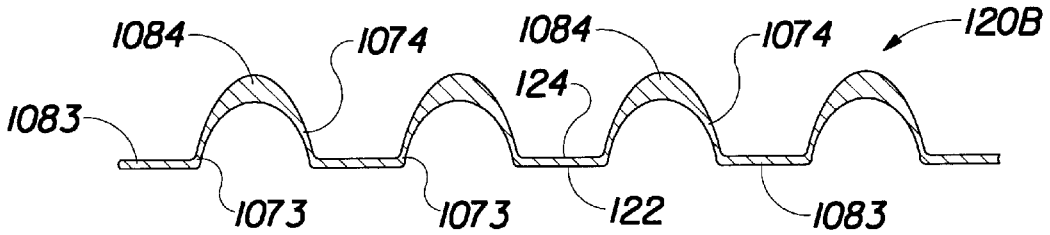
FIG. 6 is a cross-section of the paper web of FIG. 5 taken along lines 6—6 in FIG. 5.
Figure 7:
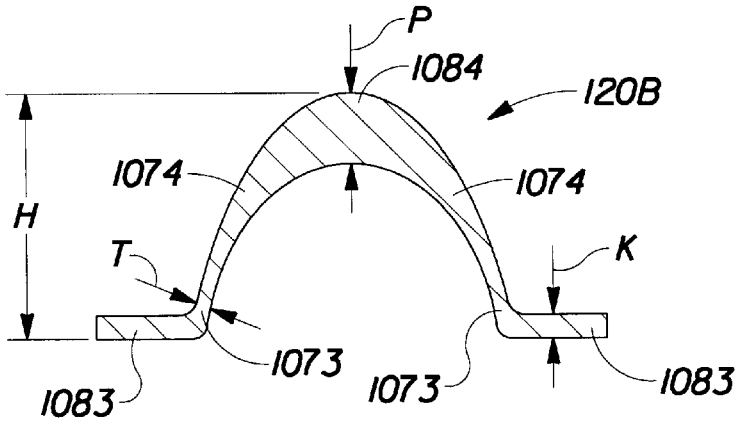
FIG. 7 is an enlarged view of a portion of FIG. 6.

The molded web 120B is preferably pressed to have a consistency of at least about 30 percent at the exit of the compression nip 300. Pressing the intermediate web 120A as shown in FIG. 1 molds the web to provide a first relatively high density region 1083 associated with the web imprinting surface 222 and a second relatively low density region 1084 of the web associated with the deflection conduit portion 230. Pressing the intermediate web 120A on an imprinting fabric 219 having a macroscopically monoplanar, patterned, continuous network web imprinting surface 222, as shown in FIGS. 2–4, provides a molded web 120B having a macroscopically monoplanar, patterned, continuous network region 1083 having a relatively high density, and a plurality of discrete, relatively low density domes 1084 dispersed throughout the continuous, relatively high density network region 1083. Such a molded web 120B is shown in FIGS. 5–7. Such a molded web has the advantage that the continuous, relatively high density network region 1083 provides a continuous loadpath for carrying tensile loads.

The molded web 120B is also characterized in having a third intermediate density region 1074 extending intermediate the first and second regions 1083 and 1084, as shown in FIG. 7. The third region 1074 comprises a transition region 1073 positioned adjacent the first relatively high density region 1083. The intermediate density region 1074 is formed as the first dewatering felt 320 draws papermaking fibers into the deflection conduit portion 230, and has a tapered, generally trapezoidal cross-section.

The transition region 1073 is formed by compaction of the intermediate web 120A at the perimeter of the deflection conduit portion 230. The region 1073 encloses the intermediate density region 1074 to at least partially encircle each of the relatively low density domes 1084. The transition region 1073 is characterized in having a thickness T which is a local minima, and which is less than the thickness K of the relatively high density region 1083, and a local density which is greater than the density of the relatively high density region 1083. The relatively low density domes 1084 have a thickness P which is a local maxima, and which is greater than the thickness K of the relatively high density, continuous network region 1083. Without being limited by theory, it is believed that the transition region 1073 acts as a hinge which enhances web flexibility. The molded web 120B formed by the process shown in FIG. 1 is characterized in having relatively high tensile strength and flexibility for a given level of web basis weight and web caliper H (FIG. 7).

A sixth step in the practice of the present invention can comprise pre-drying the molded web 120B, such as with a through-air dryer 400 as shown in FIG. 1. The molded web 120B can be pre-dried by directing a drying gas, such as heated air, through the molded web 120B. In one embodiment, the heated air is directed first through the molded web 120B from the first web face 122 to the second web face 124, and subsequently through the deflection conduit portion 230 of the imprinting member 219 on which the molded web is carried. The air directed through the molded web 120B partially dries the molded web 120B. In one embodiment the molded web 120B can have a consistency of between about 30 and about 65 percent upon entering the through air dryer 400, and a consistency of between about 40 and about 80 upon exiting the through air dryer 400.

Referring to FIG. 1, the through air dryer 400 can comprise a hollow rotating drum 410. The molded web 120B can be carried around the hollow drum 410 on the imprinting member 219, and heated air can be directed radially outward from the hollow drum 410 to pass through the web 120B and the imprinting member 219. Alternatively, the heated air can be directed radially inward (not shown). Suitable through air dryers for use in practicing the present invention are disclosed in U.S. Pat. No. 3,303,576 issued May 26, 1965 to Sisson and U.S. Pat. No. 5,274,930 issued Jan. 4, 1994 to Ensign et al., which patents are incorporated herein by reference. Alternatively, one or more through air dryers 400 or other suitable drying devices can be located upstream of the nip 300 to partially dry the web prior to pressing the web in the nip 300.

A seventh step in the practice of the present invention can comprise impressing the web imprinting surface 222 of the foraminous imprinting member 219 into the molded web 120B to form an imprinted web 120C. Impressing the web imprinting surface 222 into the molded web 120B can serve to further densify the relatively high density region 1083 of the molded web, thereby increasing the difference in density between the regions 1083 and 1084. Referring to FIG. 1, the molded web 120B is carried on the imprinting member 219 and interposed between the imprinting member 219 and an impression surface at a nip 490. The impression surface can comprise a surface 512 of a heated drying drum 510, and the nip 490 can be formed between a roll 209 and the dryer drum 510. The imprinted web 120C can then be adhered to the surface 512 of the dryer drum 510 with the aid of a creping adhesive, and finally dried. The dried, imprinted web 120C can be foreshortened as it is removed from the dryer drum 510, such as by creping the imprinted web 120C from the dryer drum with a doctor blade 524.

The method provided by the present invention is particularly useful for making paper webs having a basis weight of between about 10 grams per square meter to about 65 grams per square meter. Such paper webs are suitable for use in the manufacture of single and multiple ply tissue and paper towel products.

In an alternative embodiment of the present invention, the second felt 350 can be positioned adjacent the second face 240 of the imprinting member 219 as the molded web 120B is carried on the imprinting member 219 from the nip 300 to the nip 490. The nip 490 can be formed between a vacuum pressure roll and the Yankee drum 510.

In the embodiments shown, the imprinting member and the second felt layer 350 are separate components. Alternatively, a composite felt imprinting member can be used. Such a composite felt imprinting member is disclosed in the following U.S. patents, publications, and patent applications which are incorporated herein by reference: U.S. Pat. No. 5,556,509 issued Sep. 17, 1996 to Trokhan et al.; U.S. Pat. No. 5,580,423 issued Dec. 3, 1996 to Ampulski et al.; PCT publication WO 96/00812 published Jan. 11, 1996 in the name of Trokhan et al.; PCT publication WO 96/25547 published Aug. 22, 1996 in the name of Trokhan; U.S. patent application Ser. No. 08/701,600 filed Aug. 22, 1996 in the names of Ostendorf et al., and U.S. patent application Ser. No 08/640,452 filed Apr. 30, 1996 in the name of Ampulski et al.

Figure 9:
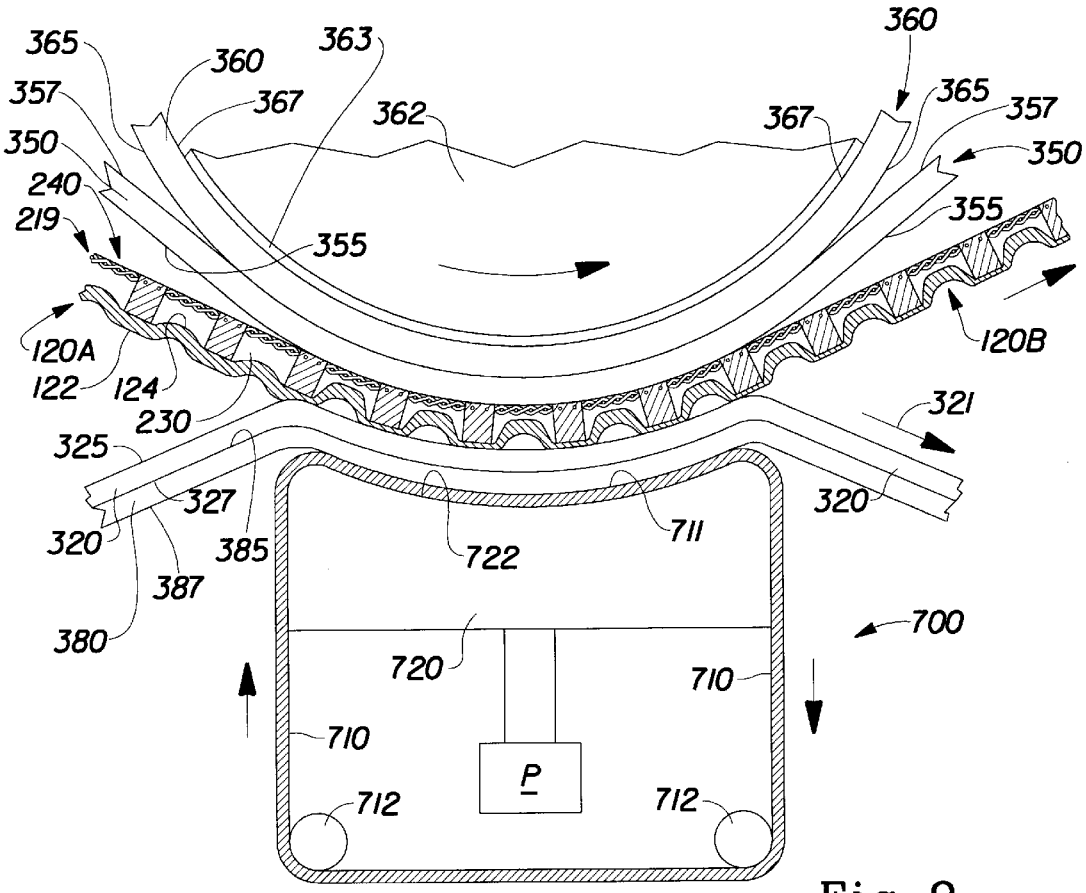
FIG. 9 is an enlarged schematic illustration of a compression nip, wherein four dewatering felt layers and an imprinting member are positioned in the nip.

In another embodiment shown in FIG. 9, a fourth felt 380 can be positioned in the nip 300, such that the first felt 320 is positioned between the web 120A and the fourth felt 380.

The fourth felt 380 has a first surface 385 and a second surface 387. The first surface 385 can have a relatively high density and relatively small pore size as compared to the surface 387. In one embodiment, the fourth felt 380 can have the same construction and properties as the first felt 320. In another embodiment the fourth felt 380 can have an air permeability less than that of the first felt 320, and the fourth felt 380 can have a water holding capacity greater than that of felt 320.

While particular embodiments of the present invention have been illustrated and described, it would be obvious to those skilled in the art that various other changes and modifications can be made without departing from the spirit and scope of the present invention.

What is claimed:

1. A method of pressing a paper web comprising the steps of:

providing a wet paper web of papermaking fibers;

providing a compression nip;

providing an imprinting member having a web contacting face comprising a continuous patterned deflection conduit encompassing a plurality of discrete isolated web imprinting surfaces;

providing a first dewatering felt, a second dewatering felt, and a third dewatering felt, wherein the three dewatering felts are separable;

positioning the paper web intermediate the imprinting member and the first dewatering felt in the compression nip;

positioning the imprinting member intermediate the second dewatering felt and the paper web in the compression nip;

positioning the second dewatering felt intermediate the imprinting member and the third dewatering felt in the compression nip; and pressing the paper web, the imprinting member, and the three dewatering felts in the compression nip, deflecting a portion of the papermaking fibers in the wet paper web into the deflection conduit to form a non-monoplanar web of papermaking fibers.

2. The method of claim 1 wherein each of the first, second, and third dewatering felts comprises a nonwoven batt of fibers.

3. The method of claim 1 wherein the each of the first, second and third felts has an air permeability between about 5 and about 200 scfm.

4. The method of claim 3 wherein the first felt has an air permeability less than that of the second felt, and wherein the third felt has an air permeability less than that of the second felt.

5. The method of claim 1 further comprising the steps of:

providing a fourth dewatering felt; and positioning the first dewatering felt intermediate the fourth felt and the paper web in the compression nip.

6. A method of forming a paper web comprising the steps of:

providing an aqueous dispersion of papermaking fibers;

providing a foraminous forming member;

providing a first dewatering felt capable of receiving and containing water pressed from a web;

providing a foraminous imprinting member having a web contacting face comprising a continuous patterned deflection conduit encompassing a plurality of discrete isolated web imprinting surfaces;

providing a second dewatering felt capable of receiving and containing water pressed from a web;

providing a third dewatering felt capable of receiving and containing water;

providing a compression nip between first and second opposed compression surfaces;

forming an embryonic web of the papermaking fibers on the foraminous forming member, the embryonic web having a first face and a second face;

transferring the embryonic web from the foraminous forming member to the imprinting member to position the second face of the embryonic web adjacent the web contacting face of the imprinting member;

deflecting a portion of the papermaking fibers on the imprinting member to form a non-monoplanar intermediate web of the papermaking fibers;

positioning the intermediate web and the imprinting member intermediate the first dewatering felt and the second dewatering felt in the compression nip, wherein the first felt is positioned adjacent the first face of the intermediate web, wherein the web imprinting surface of the imprinting member is positioned adjacent the second face of the intermediate web;

positioning the third dewatering felt adjacent the second dewatering felt in the compression nip, wherein the second dewatering felt is disposed between the imprinting member and the third dewatering felt; and pressing the intermediate web in the compression nip to further deflect the papermaking fibers into the deflection conduit to form a molded web.

7. The method of claim 6 further comprising the steps of:

separating the first dewatering felt from the molded web at the exit of the compression nip;

separating the second dewatering felt from the imprinting member at the exit of the compression nip; and supporting the molded web on the imprinting member after the web passes through the compression nip.

8. The method of claim 6 wherein each of the first, second, and third dewatering felts comprises a nonwoven batt of fibers.

9. The method of claim 6 wherein the each of the first, second and third felts has an air permeability between about 5 and about 200 scfm.

10. The method of claim 9 wherein the first felt has an air permeability less than that of the second felt, and wherein the third felt has an air permeability less than that of the second felt.

11. The method of claim 6 wherein the step of transferring the embryonic web from the foraminous forming member to the imprinting member comprises vacuum transferring the embryonic web from the forming member to the imprinting member.

12. A press assembly for dewatering a wet paper web, the press assembly comprising:

an imprinting member for supporting and imprinting the paper web, the imprinting member having a web contacting face comprising a continuous patterned deflection conduit encompassing a plurality of discrete isolated web imprinting surfaces;

a first dewatering felt;

a second dewatering felt;

a third dewatering felt; and first and second press surfaces providing a compression nip for pressing the wet paper web, the imprinting member, and the three dewatering felts, arranged therebetween, such that a portion of the papermaking fibers in the wet paper web are deflected into the continuous patterned deflection conduit to form a non-monoplanar web of papermaking fibers, wherein the imprinting member is positioned adjacent to the second felt, wherein the third felt is positioned adjacent to the second felt and wherein the imprinting member is positioned intermediate the first felt and the second felt.

13. The assembly of claim 12 wherein each of the first, second, and third dewatering felts comprises a nonwoven batt of fibers.

14. The assembly of claim 12 wherein the each of the first, second and third felts has an air permeability between about 5 and about 200 scfm.

15. The assembly of claim 14 wherein the first felt has an air permeability less than that of the second felt, and wherein the third felt has an air permeability less than that of the second felt.

16. The assembly of claim 12 further comprising a fourth felt.

* * * * *